US009325138B2

(12) United States Patent
Bryant et al.

(10) Patent No.: US 9,325,138 B2
(45) Date of Patent: Apr. 26, 2016

(54) CABLE REMOVER

(71) Applicant: International Business Machines Corporation, Armonk, NY (US)

(72) Inventors: Kevin M. Bryant, Bridgeport, CT (US); Ryan N. Elsasser, Poughkeepsie, NY (US); Steven P. Hompesch, Middlesex, NJ (US); Barry P. Knapp, Tivoli, NY (US); Enrico A. Romano, Wingdale, NY (US); Paul Samaniego, Port Ewen, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 235 days.

(21) Appl. No.: 14/094,224

(22) Filed: Dec. 2, 2013

(65) Prior Publication Data

US 2015/0155675 A1 Jun. 4, 2015

(51) Int. Cl.

| | |
|---|---|
| ***H01R 43/26*** | (2006.01) |
| *B25G 1/04* | (2006.01) |
| *H01R 24/64* | (2011.01) |

(52) U.S. Cl.

CPC *H01R 43/26* (2013.01); *B25G 1/04* (2013.01); *H01R 24/64* (2013.01); *Y10T 29/49822* (2015.01); *Y10T 29/53943* (2015.01)

(58) Field of Classification Search

CPC ..... Y10T 29/49815; Y10T 29/49822; Y10T 29/49824; Y10T 29/53943; Y10T 29/53961; Y10T 29/53974; Y10T 29/53991; H01R 43/26; B25B 13/065; B25B 23/16; B25G 1/04

See application file for complete search history.

(56) References Cited

U.S. PATENT DOCUMENTS

| | | | | |
|---|---|---|---|---|
| 4,794,663 | A * | 1/1989 | Vosbikian | A47L 13/24 15/144.1 |
| 6,254,418 | B1 | 7/2001 | Tharp et al. | |
| 7,326,075 | B1 | 2/2008 | Armstrong et al. | |
| 7,651,361 | B2 | 1/2010 | Henry et al. | |
| 7,959,455 | B1 | 6/2011 | Armstrong et al. | |
| 8,025,519 | B2 | 9/2011 | Handshaw et al. | |
| 8,235,745 | B1 | 8/2012 | Armstrong et al. | |
| 8,267,712 | B2 | 9/2012 | Huang et al. | |
| 2005/0075001 | A1 * | 4/2005 | Shearman | H01R 13/6272 439/352 |
| 2008/0172800 | A1 * | 7/2008 | Levy | B25B 27/00 7/107 |

* cited by examiner

*Primary Examiner* — Jason L Vaughan
*Assistant Examiner* — Amanda Meneghini
(74) *Attorney, Agent, or Firm* — Marcia L. Doubet

(57) ABSTRACT

A cable removal device comprises a body comprising a head portion and a rear portion, the rear portion adapted as a handle portion, the head portion comprising a bent portion extending from a front end of the head portion, the bent portion further containing tabs surrounding a gap that extends inward from the front end, the gap adapted to allow the bent portion to extend over a latch release tab of a cable connector device while the latch release tab is maintained in a latched position, without contact therewith until a subsequent movement of the body causes the body to contact the latch release tab and thereby move the latch release tab into a released position that disengages the cable connector device from a commodity connector device.

13 Claims, 4 Drawing Sheets

CABLE REMOVER

BACKGROUND OF THE INVENTION

The present invention relates to a cable removing device, and deals more particularly with removing a cable from a connector—such as a standard RJ-45 or RJ-11 connector—with a cable removal device.

One type of commonly-used connector for operably connecting a cable to a device is a so-called "RJ-45", or "Registered Jack-45", connector. An RJ-45 connector provides a connection having 8 wires, and such connectors are commonly used in local area networks such as Ethernet networks. Another type of commonly-used connector is an "RJ-11", or "Registered Jack-11", connector. An RJ-11 connector provides a connection having 4 or 6 wires, and such connectors are commonly used with telephone equipment—and to a lesser extent, also with local area networks.

BRIEF SUMMARY OF THE INVENTION

The present invention is directed toward cable removal. In one embodiment, a cable removal device according to the present invention comprises: a body comprising a head portion and a rear portion, the rear portion adapted as a handle portion, the head portion comprising a bent portion extending from a front end of the head portion, the bent portion further containing tabs surrounding a gap that extends inward from the front end, the gap adapted to allow the bent portion to extend over a latch release tab of a cable connector device while the latch release tab is maintained in a latched position, without contact therewith until a subsequent movement of the body causes the body to contact the latch release tab and thereby move the latch release tab into a released position that disengages the cable connector device from a commodity connector device. In another embodiment, the present invention comprises using such cable remover device to remove a cable.

These and other aspects of the present invention may be provided in one or more embodiments. It should be noted that the foregoing is a summary and thus contains, by necessity, simplifications, generalizations, and omissions of detail; consequently, those skilled in the art will appreciate that the summary is illustrative only and is not intended to be in any way limiting. Other aspects, inventive features, and advantages of the present invention, as defined by the appended claims, will become apparent in the non-limiting detailed description set forth below.

The present invention will be described with reference to the following drawings, in which like reference numbers denote the same element throughout.

DETAILED DESCRIPTION OF THE INVENTION

Cables are often plugged into places where a person's hands cannot easily fit, such as behind a rack of electronic equipment or in a recessed area. When a person attempts to unplug (i.e., remove) the cable, the cable may be ripped out because the person is unable to reach the latch release tab affixed to the end of the cable. This may destroy the cable and/or the connector into which the cable was plugged. Embodiments of the present invention are directed toward cable removal, using a cable remover that is designed to lessen the likelihood of damage during the removal process.

An embodiment of the present invention protects the cable from damage, and allows a person to safely remove the cable without having to use his or her hands to reach the latch release tab that disengages attachment from the connector and thereby enables the cable to be safely removed. An embodiment of the cable removal device is designed to enter small cavities which may have limited accessibility and/or which may require approaching the cavity from an angle. The cable removal device is preferably lightweight, and is designed to be easy to use and intuitive in its operation. By way of illustration but not of limitation, one material from which the cable removal device may be constructed, at least in part, is aluminum.

Figure 1:
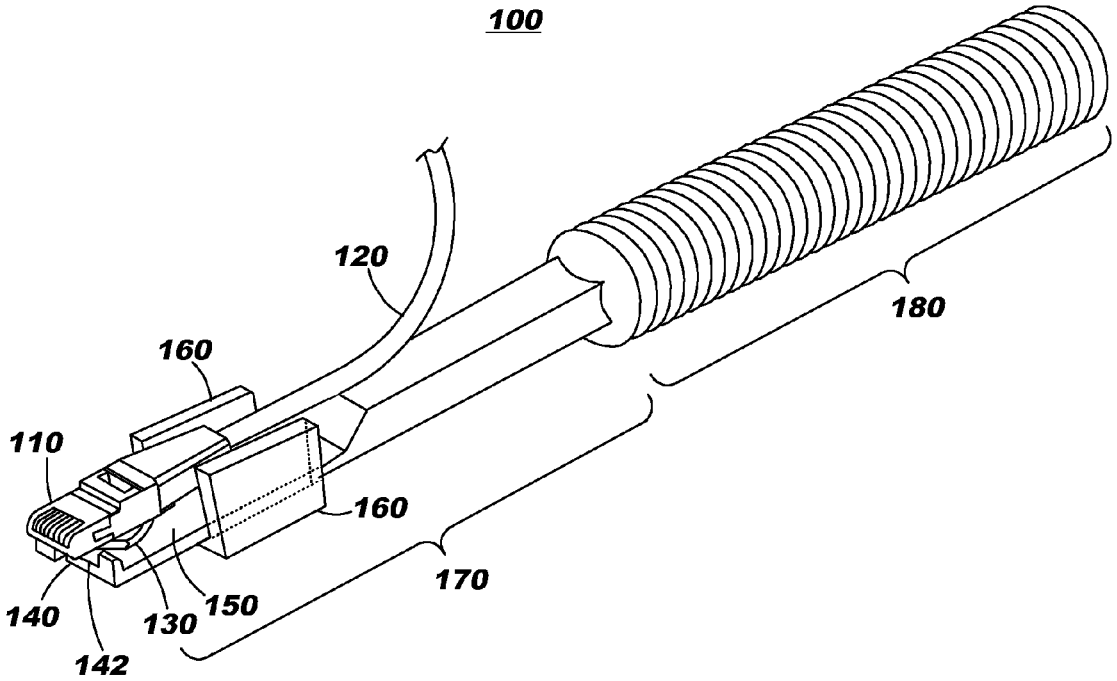
FIG. 1 illustrates an embodiment of a cable removal device according to the present invention.

Referring now to FIG. 1, an embodiment of the cable removal device 100 is illustrated, as well as an example of a known cable connector device 110 (referred to equivalently herein as a cable connector 110) which is attached to an end of a cable 120. The cable connector 110 includes a latch release tab 130, and is adapted for plugging into a known commodity connector device (not shown, and referred to equivalently herein simply as a commodity connector), as is readily understood by those of ordinary skill in the art. Typically, the commodity connector is contained within an electronic device or recessed into a location such as a wall socket, as is also readily understood by those of ordinary skill in the art. An operable connection is made by plugging cable connector 110 into a commodity connector, using known techniques, which causes the latch release tab 130 to engage such that the cable connector 110 thereby holds the cable 120 in place within the commodity connector.

Figure 2:
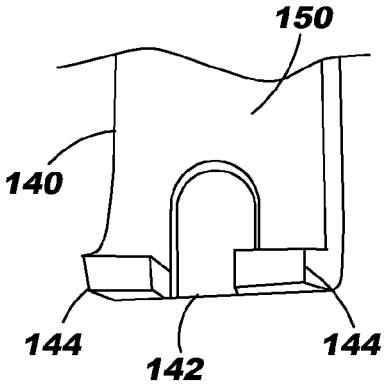
FIG. 2 provides further detail of a front end of the cable removal device, and FIG. 3 provides further detail of an optional guide portion of the device.

It is known for technicians to attempt cable removal using a screwdriver to depress a latch release tab 130 of a cable connector 110. However, the screwdriver sometimes damages the cable connector 110, which may include breaking the latch release tab 130, piercing a shielding gasket that surrounds the entrance to the commodity connector, damaging the interior surface of the commodity connector, and so forth. Cable removal device 100, by contrast, is designed to avoid this type of damage. As shown in further detail in FIG. 2, a front end portion 140 of a head portion 170 is designed to include a bent portion comprising tabs 144 surrounding a gap 142. The bent front end, and more particularly the tabs 144, prevents the device 100 from entering the interior cavity of a commodity connector. This design also lessens the likelihood that device 100 will damage the shielding gasket that surrounds the entrance to the commodity connector. (Shielding gaskets are commonly constructed from thin deposits of silicone, copper, or similar materials, and are thus susceptible to damage from scratching or other abrasion.)

The gap 142 is positioned to extend inwardly from the edge of front end portion 140, and to thereby straddle the latch release tab 130 when a person positions the device 100 in an area containing a plugged-in cable prior to being ready to pull the cable, thereby allowing the cable removal device 100 to pass over the latch release tab 130 without depressing the tab 130. Thus, the tab 130 is not damaged in this process. A slight maneuvering of the cable removal device 100 then activates the latch release tab 130 when the person is ready to remove the cable. Preferably, this maneuvering comprises downward movement of handle portion 180 (see FIG. 1) to cause corresponding upward movement of the bent portion extending from the front end portion 140, which in turn causes a surface 150 of the front end portion 140 to contact the tab 130 and thereby depress it.

Figure 3:
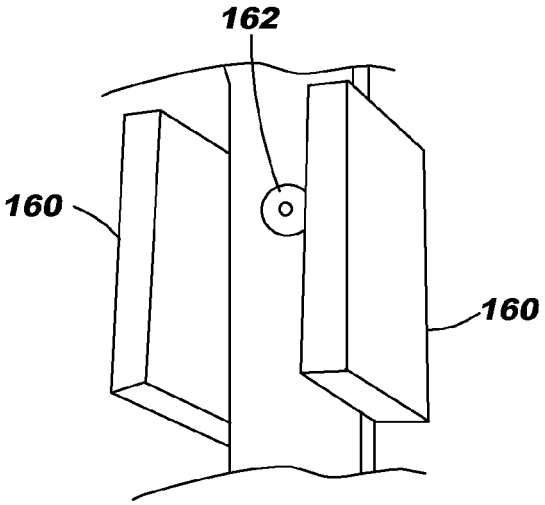

FIG. 1 also shows a guide portion 160, which is shown in further detail in FIG. 3. Guide portion 160 is an optional aspect of device 100, and may be constructed (by way of illustration but not of limitation) from nylon. A screw 162 or other connector may be used to attach the guide portion 160 to the head portion 170, by way of illustration but not of limitation. When provided, guide portion 160 assists a person using the cable removal device 100 in locating the cable connector 110 by following along the cable 120 to its entrance into cable connector 110 (which in turn is positioned within a commodity connector), and guide portion 160 may also serve to hold the cable 120 in place during the removal operation. The guide portion 160 is preferably designed to be slid around the cable 120 so that the device 100 can safely enter the area in which the cable connector 110 is located, while the gap 142 passes over the latch release tab 130 without damage thereto.

Figure 4:
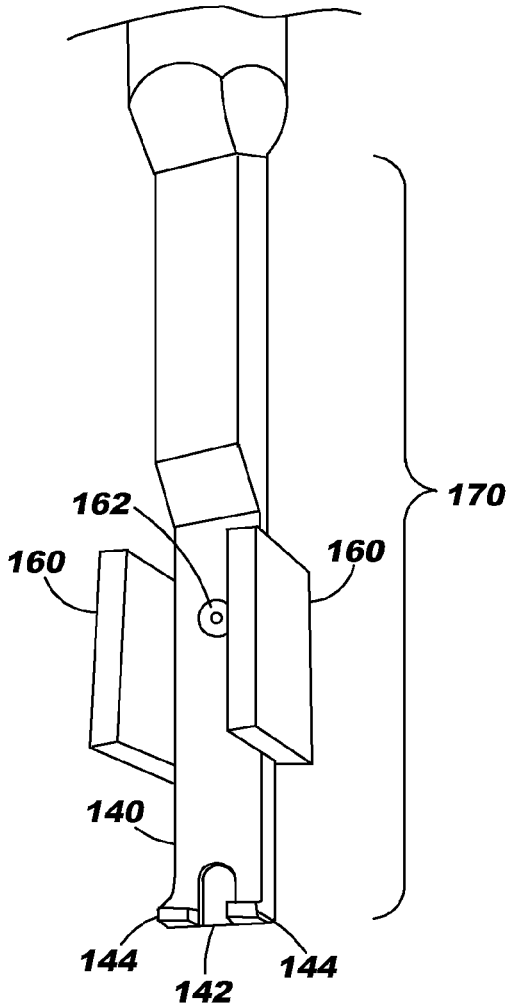
FIG. 4 provides a view of a head portion of the cable removal device.

FIG. 4 provides a view showing further detail of head portion 170 of the cable removal device 100. An exemplary placement of guide portion 160 relative to front end portion 140 is depicted, by way of illustration but not of limitation.

Figure 5:
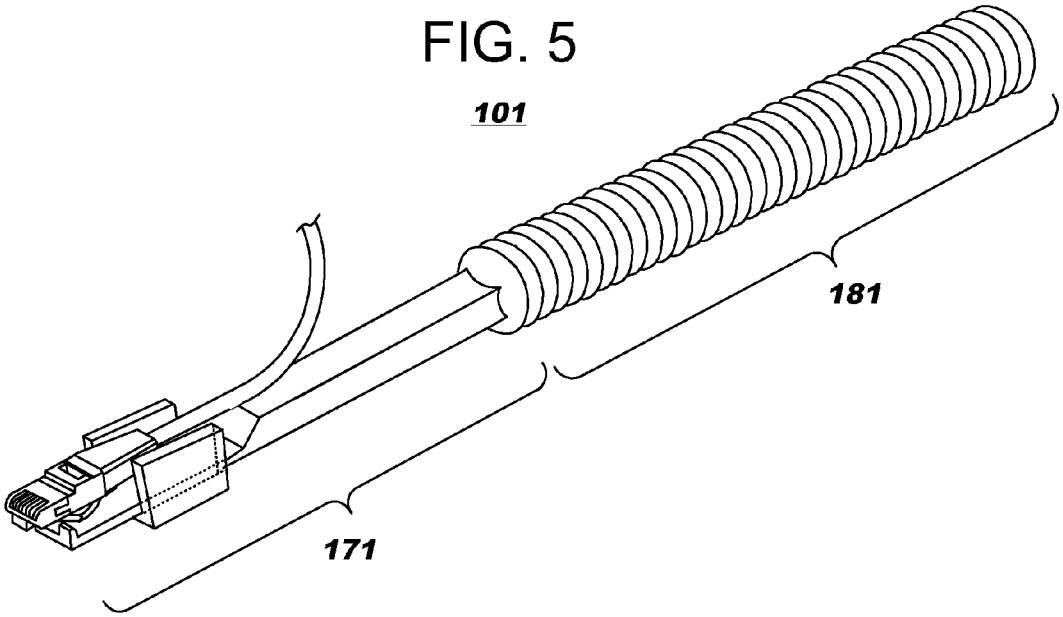
FIG. 5 provides a view of the cable removal device illustrating optional aspects whereby a head portion and/or handle portion are extendable.

Referring again to FIG. 1, a handle portion 180 of the cable removal device 100 is depicted. This handle portion 180 may optionally be extendable. In addition or instead, the above-discussed head portion 170 of the cable removal device 100 may optionally be extendable. See FIG. 5, where an alternative embodiment 101 of the cable removal device containing these extendable portions 171, 181 is illustrated. Extending the reach of the cable removal device 100 in either or both of these aspects may increase a person's ability to reach the cable connector 110 in various locations, such as when the cable connector 110 is placed close to a wall, or when cable connector 110 is seated within a relatively deeper cavity of a commodity connector, and so forth. As one alternative to providing an extendable handle or extendable head portion, the cable removal device 100 may be manufactured with a head portion 170 and/or handle portion 180 of various static lengths.

Optionally, the head portion 170 may pivot, thereby allowing the cable removal device 100 to approach a cable connector 110 from varying angles. This optional pivoting aspect will now be described with reference to FIGS. 6-8, where the pivoting head portion and the handle portion to which it attaches are now denoted by reference numbers 172 and 182 (respectively), and where the cable removal device providing this pivoting aspect is now denoted by reference number 102.

Figure 6:
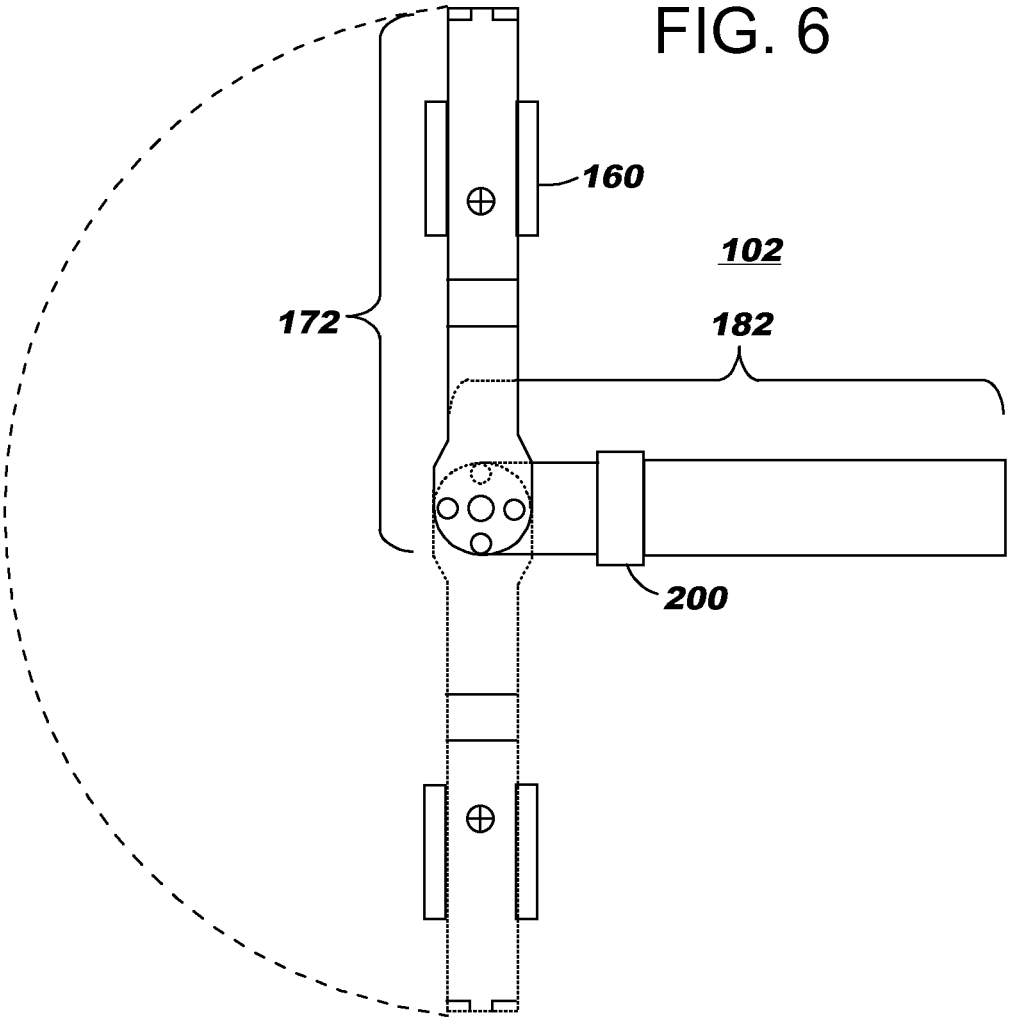
FIGS. 6-8 depict an optional aspect whereby the head portion of the cable device pivots.

In one embodiment, the head portion 172 of a pivoting cable removal device 102 pivots between 0 and 90 degrees in either direction, as shown in FIG. 6. Such pivoting may increase a person's ability to access a cable connector 110 in a location that requires reaching around a corner, or which cannot be accessed from a straight line for other another reason, for example.

Figure 7:
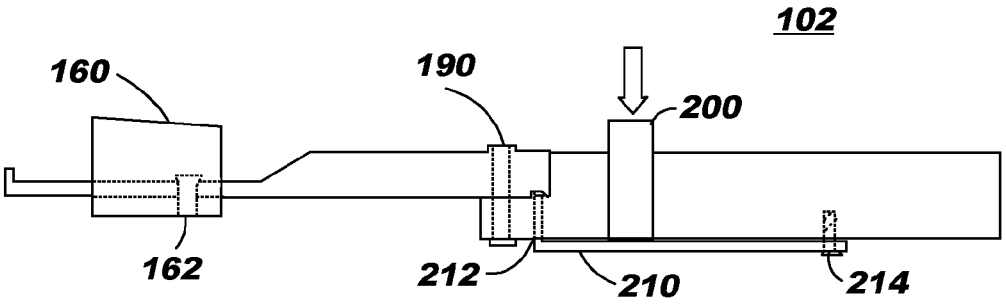

FIG. 7 illustrates a side view of one embodiment of a pivoting cable removal device 102. As shown therein, a pin 190 attaches the head portion 172 to the handle portion 182 and serves as a pivot point. An actuator 200 is added to the handle portion 182, where this actuator 200 can be depressed by a user to cause downward movement of a release mechanism 210 which is attached to the handle portion 182 by a screw 214 or similar connector. The downward movement of release mechanism 210 causes a protruding portion 212 of release mechanism 210 to become disengaged from, or otherwise removed from contacting, the head portion 172, and this in turn allows the head portion 170 to pivot.

Figure 8:
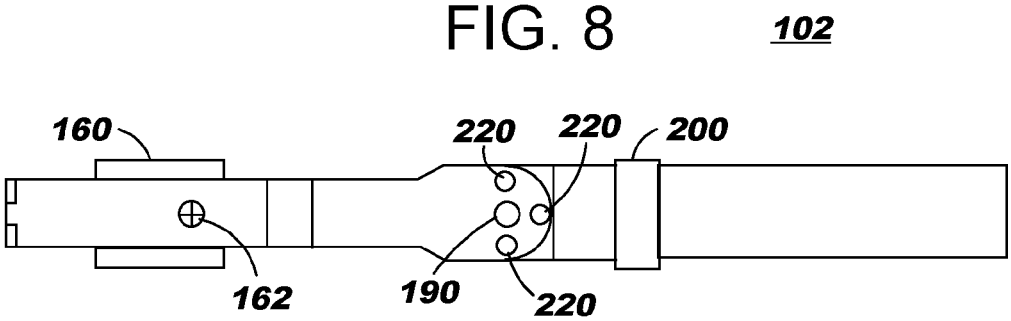

FIG. 8 illustrates a top view of one embodiment of a pivoting cable removal device 102. Pin 190, which serves as the pivot point, is shown therein. One or more cavities 220, which serve to lock the head portion 172 at particular rotational configurations, are also shown. Cavities 220 are preferably drilled into head portion 172 for the protruding portion 212 to sit in when actuator 200 is not pressed downward. The cavities 220 thus preferably provide a seat for protruding portion 212 of release mechanism 210 to prevent rotation and allow the tool to lock at angles of 0, 90, and 180 degrees.

Using an embodiment of the present invention provides advantages which have been discussed above, including ease of removing cables while providing less likelihood of damaging cables, latch release tabs, connectors, shielding gaskets, and so forth. Use of a cable removal tool such as device 100, 101, or 102 for removing a cable is also within the scope of the present invention.

While embodiments of the present invention have been described, additional variations and modifications in those embodiments may occur to those skilled in the art once they learn of the basic inventive concepts. Therefore, it is intended that the appended claims shall be construed to include the described embodiments and all such variations and modifications as fall within the spirit and scope of the invention.

The invention claimed is:

1. A cable removal device, comprising:

a body comprising a head portion and a rear portion, the rear portion adapted as a handle portion, wherein a length of the handle portion is extendable, the head portion comprising a bent portion extending from a distal end of the head portion, the bent portion further containing tabs surrounding a gap that extends inward from the distal end, wherein a guide portion is affixed to the body, the guide portion being separate from the tabs and located along the body between the tabs and the handle portion, the gap adapted to allow the bent portion to extend over a latch release tab of the cable connector device while the latch release tab is maintained in a latched position, without contact therewith until a subsequent movement of the body causes the body to contact the latch release tab and thereby move the latch release tab into a released position that disengages the cable connector device from a commodity connector device.

2. The cable removal device according to claim 1, wherein the cable connector device is an RJ-45 connector.

3. The cable removal device according to claim 1, wherein the cable connector device is an RJ-11 connector.

4. The cable removal device according to claim 1, wherein the body is formed substantially from aluminum.

5. The cable removal device according to claim 1, wherein a length of the head portion is extendable.

6. The cable removal device according to claim 1, wherein the subsequent movement of the body comprises downward movement of the handle portion to cause corresponding upward movement of the head portion.

7. The cable removal device according to claim 1, wherein the head portion is adapted to pivot.

8. The cable removal device according to claim 1, wherein the head portion is adapted to pivot between 0 and 90 degrees.

9. The cable removal device according to claim 8, wherein an actuator is affixed to the handle portion, the actuator being operable to cause downward movement of a release mechanism that disengages the head portion for pivoting.

10. A method of removing a cable from a commodity connector device, comprising:

positioning a cable removal device over a cable which is connected to a cable connector device, the cable removal device comprising a body comprising a head portion and a rear portion, the rear portion adapted as a handle portion, wherein a length of the handle portion is extendable, the head portion comprising a bent portion extending from a distal end of the head portion, the bent portion further containing tabs surrounding a gap that extends inward from the distal end, wherein a guide portion is affixed to the body, the guide portion being separate from the tabs and located along the body between the tabs and the handle portion, the gap adapted to allow the bent portion to extend over a latch release tab of the cable connector device while the latch release tab is maintained in a latched position, without contact therewith; and causing a subsequent movement of the body, thereby placing the body in contact with the latch release tab and thereby moving the latch release tab into a released position that disengages the cable connector device from a commodity connector device.

11. The method according to claim 10, wherein the subsequent movement of the body comprises downward movement of the handle portion to cause corresponding upward movement of the head portion.

12. The method according to claim 10, wherein the cable connector device is an RJ-45 connector.

13. The method according to claim 10, wherein the cable connector device is an RJ-11 connector.

* * * * *